US007413802B2

(12) United States Patent
Karayianni et al.

(10) Patent No.: US 7,413,802 B2
(45) **Date of Patent: *Aug. 19, 2008**

(54) ENERGY ACTIVE COMPOSITE YARN, METHODS FOR MAKING THE SAME, AND ARTICLES INCORPORATING THE SAME

(75) Inventors: Eleni Karayianni, Geneva (CH); George W. Coulston, Pittsburgh, PA (US); Thomas A. Micka, West Grove, PA (US)

(73) Assignee: Textronics, Inc., Wilmington, DE (US)

( * ) Notice: Subject to any disclaimer, the term of this patent is extended or adjusted under 35 U.S.C. 154(b) by 393 days.

This patent is subject to a terminal disclaimer.

(21) Appl. No.: 11/161,766

(22) Filed: Aug. 16, 2005

(65) Prior Publication Data

US 2007/0042179 A1 Feb. 22, 2007

(51) Int. Cl.
*D02G 3/00* (2006.01)

(52) U.S. Cl. ..... 428/370; 428/377; 57/210; 57/211

(58) Field of Classification Search ..... 428/370, 428/377; 57/210, 211, 233, 234
See application file for complete search history.

(56) References Cited

U.S. PATENT DOCUMENTS

| | | | | |
|---|---|---|---|---|
| 3,273,978 | A * | 9/1966 | Francis | 428/592 |
| 3,288,175 | A | 11/1966 | Valko | |
| 3,336,174 | A * | 8/1967 | Dyer et al. | 156/167 |
| 3,354,630 | A * | 11/1967 | Segal | 57/235 |
| 3,625,809 | A * | 12/1971 | Caroselli et al. | 428/222 |
| 3,979,648 | A * | 9/1976 | Toyoshima et al. | 361/191 |
| 4,228,641 | A * | 10/1980 | O'Neil | 57/234 |
| 4,299,884 | A * | 11/1981 | Payen | 428/377 |
| 4,433,536 | A * | 2/1984 | O'Neil | 57/233 |
| 4,525,992 | A | 7/1985 | Payen et al. | |
| 4,544,603 | A * | 10/1985 | Richards | 428/371 |
| 4,654,748 | A | 3/1987 | Rees | |
| 4,777,789 | A | 10/1988 | Kolmes et al. | |
| 4,813,219 | A | 3/1989 | Rees | |
| 4,878,148 | A | 10/1989 | Hee | |
| 5,288,544 | A | 2/1994 | Mallen et al. | |

(Continued)

FOREIGN PATENT DOCUMENTS

| | | |
|---|---|---|
| GB | 2156592 | 10/1985 |

(Continued)

OTHER PUBLICATIONS

F. Clemens, et al., "Computing Fibers: A novel fiber for Intelligent Fabrics?", Advanced Engineering Materials 2003, vol. 5, No. 9, pp. 682.

(Continued)

*Primary Examiner*—N Edwards
(74) *Attorney, Agent, or Firm*—Connolly Bove Lodge & Hutz LLP

(57) ABSTRACT

Energy active composite yarns include at least one textile fiber member of either an elastic or inelastic material, and at least one functional substantially planar filament, which surrounds or covers the textile fiber member. The composite yarns can include an optional stress-bearing member, which also surrounds or covers the textile fiber member. The composite yarns may be multifunctional, meaning the functional substantially planar filament can exhibit combinations of electrical, optical, magnetic, mechanical, chemical, semiconductive, and/or thermal energy properties.

34 Claims, 2 Drawing Sheets

U.S. PATENT DOCUMENTS

| | | | | |
|---|---|---|---|---|
| 5,632,137 | A | 5/1997 | Kolmes et al. | |
| 5,910,361 | A * | 6/1999 | Guevel et al. | 428/364 |
| 6,105,224 | A | 8/2000 | O'Mara, Jr. et al. | |
| 6,138,336 | A | 10/2000 | Goineau | |
| 6,341,504 | B1 | 1/2002 | Istook | |
| 6,581,366 | B1 | 6/2003 | Andrews | |
| 6,803,332 | B2 * | 10/2004 | Andrews | 442/197 |
| 6,856,715 | B1 | 2/2005 | Ebbesen et al. | |
| 7,135,227 | B2 * | 11/2006 | Karayianni et al. | 428/370 |
| 7,147,904 | B1 * | 12/2006 | Crawford | 428/36.1 |
| 2002/0050446 | A1 | 5/2002 | Antoniazzi | |
| 2002/0130624 | A1 | 9/2002 | Nakamura | |
| 2002/0189839 | A1 | 12/2002 | Wagner et al. | |
| 2004/0237494 | A1 | 12/2004 | Karayianni et al. | |
| 2005/0282009 | A1 | 12/2005 | Nusko et al. | |

FOREIGN PATENT DOCUMENTS

| | | | |
|---|---|---|---|
| WO | 02/095839 | A2 | 11/2002 |
| WO | WO-03/021679 | A2 | 3/2003 |
| WO | WO-03/023880 | A2 | 3/2003 |
| WO | WO-20040271323 | | 4/2004 |
| WO | WO 2004097089 | * | 11/2004 |
| WO | WO 2006128633 | * | 1/2006 |

OTHER PUBLICATIONS

J.B. Lee et al., "Organic Transistors on Fiber", IEDM 2003, pp. 8.3.1-8.3.4.

* cited by examiner

ENERGY ACTIVE COMPOSITE YARN, METHODS FOR MAKING THE SAME, AND ARTICLES INCORPORATING THE SAME

FIELD OF THE INVENTION

The present invention relates to energy active textile yarns. In particular, this invention relates to textile yarns containing electrically or opto-electrically active planar elements distributed along at least a portion of the length of the textile yarn, a process for producing the same, and to fabrics, garments, and other articles incorporating such yarns. Such yarns can be constructed to be multifunctional yarns, meaning that the planar elements can exhibit combinations of electrical, optical, magnetic, mechanical, chemical, semiconductive, and/or thermal energy properties.

BACKGROUND OF THE INVENTION

Fibers and filaments that have an active functionality when connected to an energy source have been included in textile yarns. Such functional fibers and filaments can include electrically conductive metallic wires or stainless steel fibers for the purpose of conducting electrical current, transmitting signals or data, shielding from electromagnetic fields or electrical heating. In addition, metallic or electrically conductive surface coatings can be applied onto yarns for these same purposes. Such functional fibers and filaments can also include optical fibers for the purpose of providing data or light transmission, or acting as deformation sensors. Such fibers and composite yarns including such fibers or coatings have been fabricated into fabrics, garments, and apparel articles.

There is a perceived need for textile yarns that have a high level functionality when connected to an energy source (sometimes referred to as "smart electronic textiles"). Smart electronic textiles include those textiles in which the textile itself can provide the elements of a classical electronic circuit, which can be delivered through the textile structural elements, i.e., yarns. Depending on the integration complexity, such textile yarns can provide an advanced embedded and active functionality into the textile and can thus allow the textile to act as a truly integrated electronic structure. Textile yarns for so-called "smart electronic textiles" can include at least one material that acts (a) as a passive component (for example, a resistor, inductor, or capacitor), (b) as an energy source (for example, a battery), (c) as a semiconductor device (for example, a diode or transistor), or (d) as a transducer (for example, a photovoltaic or light emitting material).

In this regard, FiCom, a European Union funded project within the Information Society Technologies research program, is working to integrate computing ability directly into fibers that can then be woven into textile products. FiCom's efforts have focused on embedding the basic unit of computation, the transistor, into fibers that may then be connected to form inverters, gates, and higher level circuits (F. Clemens, et al., "Computing Fibers: A novel fiber for Intelligent Fabrics?", Advanced Engineering Materials 2003, vol. 5, No. 9, pp. 682) ("Clemens"). FiCom seeks different processes to develop new substrates in fiber form that are suitable for semiconductor processing. One such process, disclosed in WO 03/021679 A2 (to A. Mathewson, et al.), includes a first step involving forming transistors on special silicon-on-insulator (SOI) substrates according to conventional techniques, followed by extraction of long thin membrane polycrystalline silicon fibers from the wafer substrate using standard etching techniques. This technique provides short planar fibers that are limited by the wafer surface (of length of about 42 mm and cross section of 35×1 μm) and can be difficult to handle.

A second process, disclosed in Clemens, involves, in a first step, producing pure continuous $SiO_2$ and SiC fibers via a ceramic powder extrusion technique, followed by sintering to yield polycrystalline SiC fibers and pure amorphous $SiO_2$ glass fibers. Although continuous filaments can be produced by this process based on inherently semiconductive materials, integrating electronic functionality on such a curved surface currently requires a complex process that has yet to be demonstrated along the length of the fiber. Further, the Clemens and Mathewson approaches are based on traditional silicon semiconductor manufacturing processes, which may present further limitations with regard to cost, process scalability, and complexity of the electronic functionalities that can be achieved. In addition, the mechanical characteristics of the resulting fibers may fail to possess desired textile characteristics.

Other attempts to incorporate transistors into textile fabrics have also been disclosed. For example, IEDM 2003 publication "Organic Transistors on Fiber", by J. B. Lee and V. Subramanian, fabricates fiber transistors using textile technology. Based on the disclosed process, aluminum wires of 250 μm and 500 μm diameter were woven in a textile to form gate interconnects. A 150 nm to 200 nm low temperature oxide gate dielectric was deposited to encapsulate the gate. Source and drain contacts were patterned via orthogonal over-woven 50 □m diameter wires that served as channel masks and 100 nm gold was evaporated to form source/drain contact pads. After removing the over-woven fibers, arrays of transistors resulted similar to thin film transistors ("TFTs"), wherein each transistor was formed at every intersection. Although adequate electrical characteristics of the resulting fiber transistors have been reported for this fabrication method, such method is impractical for producing fibers on a large scale basis.

U.S. Pat. No. 6,856,715 B1, published 9 Nov. 2000, (Ebbesen, et al.), discloses an apparatus and a method for producing fabric-like electronic circuit patterns created by appropriately joining electronic elements via textile fabrication methods. The disclosed objective is to provide a lithography-free process to produce electronic and opto-electronic devices in sheet or fabric forms, or three dimensional structures that are different from traditional semiconductor processes. Further disclosed in this patent is the use of single component and multi-component fibers, wherein the components of the fibers can be arranged in different ways in the cross-section and/or along the axis of the fiber. Such fibers can possess various functionalities or combinations of functionalities, including electrical conductivity, semiconductivity, or optical conductivity, and can further include sensors or detectors activated by light, heat, chemicals, and electric or magnetic fields. The fibers may be bundled or braided. They can then be integrated into a fabric web pattern formation to obtain the desired functionality. Although this patent discloses an apparatus based on fiber and fabric predetermined forms and patterns, it does not disclose a way to fabricate the fibers so as to create the desired electronic and opto-electronic functionalities.

WO 03/023880 A2, published 20 Mar. 2003 (Neudecker, et al.), discloses fabricating multiple-layer and multi-function thin-film patterns, including solid-state thin-film batteries, on fibers. This application provides a method for non-contact deposition of functional layers, such as anodic, electrolytic, cathodic, electrically conductive, or semiconductor layers, on the surface of a fiber or portion of the fiber by means of shadow masking a vacuum coating process on a fibrous substrate. Although this process may lead to functional fibers, the process conditions and material deposition may severely affect the original fiber properties, with subsequent loss of characteristics required for textile processing.

U.S. Pat. Application 2005/0040374 A1, published 24 Feb. 2005 (Chittibabu et al.), discloses fabricating a photovoltaic cell from photovoltaic fibers. This application discloses a fiber core, which can be electrically insulating or electrically conductive. In the case of an insulating fiber core, an inner electrical conductor is disposed upon the surface of the fiber. This core is surrounded by a photoconversion material (which can include a photosensitive nanomatrix material and a charge carrier material), a catalytic media adjacent to the charge carrier material to facilitate charge transfer or current flow, and a light transmitting electrical conductor at the outer surface. In one embodiment, the photovoltaic fiber is formed by coating all materials onto the fiber core one after the other, while wrapping a strip of the light transmitting electrical conductor around the fiber in a helical pattern. Although this process may lead to functional fibers and may be suitable from a manufacturing point of view, material deposition over the fiber surface may severely affect the original fiber properties with subsequent loss of characteristics required for textile processing. Furthermore, the fiber must exhibit desirable thermal characteristics (i.e., a glass transition temperature of less than 300° C.). Also, with the layer-by-layer approach it can be difficult to achieve the desired durability and electrical performance in the final system.

Each of the above disclosures appears to achieve a desired functionality by post-processing a textile fiber via direct surface modification on the fiber surface. Such methods may fail to produce embedded electronic functionalities that are highly resistant to fracture during mechanical deformation, for example during bending or flexing as occurs in textile processing. In addition, none of the above disclosures appears to provide a fiber that can keep its original textile characteristics. Moreover, no disclosure appears to provide a fiber with elastic stretch and recovery properties. In this regard, the inability of a fiber to stretch and recover from stretch is a notable limitation in applications in which stretch and recovery properties are important (such as in many types of wearable articles and apparel). Furthermore, if integration of such functional fibers into the textile structure requires that the textile electronic functionality be rendered through the contacts provided by the functional fibers, the curved non-planar geometry of the fiber may not be the optimum for an acceptable electrical performance.

In view of the foregoing, it would be desirable to provide an energy activated textile yarn with planar active elements and mechanical properties that can be processed using traditional textile means to produce knitted, woven, or nonwoven fabrics.

SUMMARY OF THE INVENTION

An energy active composite yarn has at least one textile fiber member and at least one functional substantially planar filament surrounding the textile fiber member. In one embodiment, the functional substantially planar filament has a length that is greater than the drafted length of the textile fiber member, such that substantially all of the elongating stress imposed on the composite yarn is carried by the textile fiber member.

The textile fiber member can include an elastic material, such as spandex, or an inelastic material, or a combination of elastic material and inelastic material. The functional substantially planar filament can, for example, include an electrically active material, an optically active material, and/or a magnetically active material and can, in at least one embodiment, allow the energy active composite yarn to be multifunctional.

In another embodiment, the energy active composite yarn may further include at least one stress-bearing member surrounding the textile fiber member. The stress bearing member has a total length that is shorter than the length of the functional substantially planar filament, but greater than, or equal to, the drafted length of the textile fiber member. At least a portion of the elongating stress imposed on the composite yarn is carried by the stress-bearing member.

The present invention further relates to methods for forming energy active composite yarns, as well as to fabrics and garments containing such energy active composite yarns.

BRIEF DESCRIPTION OF THE DRAWINGS

The invention will be more fully understood from the following detailed description, taken in connection with the accompanying drawings, which form a part of this application and in which.

DETAILED DESCRIPTION OF THE INVENTION

Figure 1:
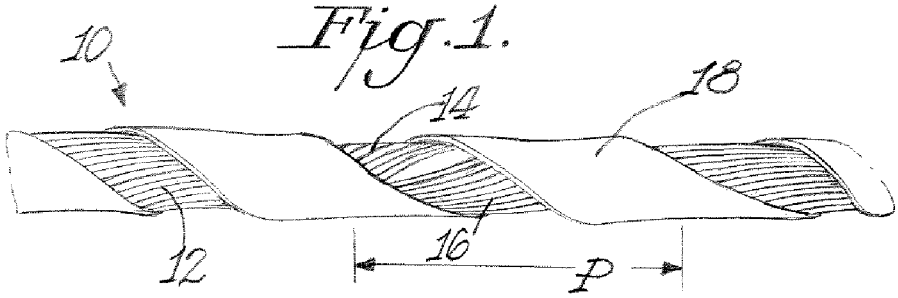
FIG. 1 is a schematic representation of an inelastic energy active composite yarn of the present invention, including an inelastic textile fiber core having two strands of Nylon multifilament yarns twisted together and a slit energy active film wrapped about the textile core.

The present invention can provide energy active composite yarns that have mechanical integrity, as well as stretch and recovery properties. Such mechanical properties are typically desirable in a yarn, fabric, or garment, including a yarn, fabric, or garment that is able to convert or use energy (or to control a response to the same or another energy form) or to perform high level electronic functions. The present invention includes yarns that are multifunctional yarns.

The stretch and recovery property or "elasticity" of a yarn or fabric is its ability to elongate in the direction of a biasing force (in the direction of an applied elongating stress) and return substantially to its original length and shape, substantially without permanent deformation, when the applied elongating stress is relaxed. In the textile arts, it is common to express the applied stress on a textile specimen (e.g., a yarn or filament) in terms of a force per unit of cross section area of the specimen or force per unit linear density of the unstretched specimen. The resulting strain (elongation) of the specimen is expressed in terms of a fraction or percentage of the original specimen length. A graphical representation of stress versus strain is the stress-strain curve, which is well-known in the textile arts.

The degree to which a fiber, yarn, or fabric returns to the original specimen length before it is deformed by an applied stress is called "elastic recovery". In stretch and recovery testing of textile materials, it is also important to note the elastic limit of the test specimen. The elastic limit is the stress load above which the specimen shows permanent deformation. The available elongation range of an elastic filament is that range of extension throughout which there is no permanent deformation. The elastic limit of a yarn is reached when the original test specimen length is exceeded after the deformation inducing stress is removed. Typically, individual filaments and multifilament yarns elongate (strain) in the direction of the applied stress. This elongation is measured at a specified load or stress. In addition, it is useful to note the elongation at break of the filament or yarn specimen. This breaking elongation is that fraction of the original specimen length to which the specimen is strained by an applied stress, which ruptures the last component of the specimen filament or multifilament yarn. Generally, the drafted length is given in terms of a draft ratio equal to the number of times a yarn is stretched from its relaxed unit length.

Developing materials that possess both desirable mechanical properties (i.e., stretch and recovery, etc.) for fibers, yarns, or fabrics as well as high level electronic and opto-electronic functionalities can be a challenge. Traditionally, materials having high level electronic and opto-electronic functionalities, such as, for example, integrated circuits, and whole micro-systems, including sensors and actuators, have been developed on single-crystalline silicon and inorganic semiconductor materials. Although such materials have unparalleled electronic properties, they are mechanically hard, and the systems based on such materials are therefore rigid and lack mechanical flexibility. As the micro-system becomes more complex, size and space limitations also become considerably important.

Although fabrication of these devices has been conventionally associated with the requirement of high temperature processes, thin-film inorganic semiconductor technologies are now being developed compatible with low temperature-resistant substrate materials, including amorphous silicon, and polycrystalline silicon. Progress on novel materials (inherently conductive polymers, organic electronic materials) that allow for novel processing technologies beyond clean room, vacuum deposition, lithographic, etching and layer-by-layer techniques (such as solution processing and printing, molding, soft lithography, lamination) are currently leading into the development of large area, low temperature, lightweight, low cost and especially structurally flexible electronics. Organic light-emitting devices, photovoltaic devices, batteries, lasers, transistors and integrated circuits have been demonstrated.

In addition, progress is being made in the development of roll-to-roll processing of plastic electronics in which the patterning of the functionalities onto polymer or paper substrates is obtained via ink-jet, gravure, off-set, or screen printing, and which results in a new generation of thin, flat, flexible electronic films. Film substrates typically used include polyester types, such as polyethylene terephthalate (PET), polyethylene naphthalate (PEN), polyimide, or fluoropolymer. Sources of electronic film substrates include, but are not limited to: CPFilms Inc., Virginia, USA; Toray Metallized Films, Japan; and Intelicoat Technologies, Mass., USA. Sources of roll-to-roll thin-film capabilities include, but are not limited to: ITN Energy Systems, Colo., USA; Polymer Vision, Philips Technology Incubator, Eindhoven, the Netherlands; Rolltronics Corporation, Calif., USA; and Precisia LLC, Mich., USA. In general, these films are produced as large area substrates from a few centimeters to a few meters wide and can be several kilometers long. These films have typically been used alone or in combination with electronic devices. Their typical dimensions are not appropriate for direct integration in textiles because typical textile fibers, by comparison, have diameters ranging from about 10 μm to about 300 μm. The mechanical strength versus elongation properties of such films may also be inadequate for use with textiles. For example, many elastic synthetic polymer-based textile yarns stretch to at least 125% of their unstressed specimen length and recover more than 50% of this elongation upon relaxation of the stress.

In other applications, textile yarns have been made to contain flat, metallized films. Such yarns are typically made from cellulose acetate or plastic (such as polyethylene-terephthalate) films, which are laminated to metal foils or are metallized by high vacuum metal vaporization followed by lamination or application of a protective coating. These yarns are typically slit from plastic webs that have been metallized and coated on either or both sides. Such yarns are typically 1/150 to ¼ inches in width and can have a thickness of 25 to 100 gauge (0.25 to 1.0 mils). They have been fabricated into fabrics, garment, and apparel articles and are almost solely used for the purpose of providing decorative and styling effects, typically serving no other functional purposes.

In accordance with the present invention it has been found that it is possible to produce an energy active composite yarn containing planar filaments that possess at least one functional property. In addition, it has been found that it is possible to produce an energy active multifunctional composite yarn that comprises a textile fiber member and at least one functional substantially planar filament. The textile fiber member, which can be elastic or inelastic, includes one or more filaments with textile-like stress-strain properties that may also have elastic stretch and recovery properties. Such filaments may be provided together in parallel, twisted, or plied form.

The textile fiber member is surrounded by (e.g. substantially covered) or co-extensive with the at least one functional substantially planar filament. Each functional substantially planar filament may be monolayer or multilayer (i.e., include a plurality of two or more layers). In addition, each functional substantially planar filament can be laminated of multiple layers or films. Each functional substantially planar filament has a length that is equal to or greater than the drafted length of the textile fiber member such that substantially all of an elongating stress imposed on the composite yarn is carried by the textile fiber member.

Generally, the textile fiber member has a relaxed unit length (L) and a drafted length of (N×L) (in the case that the textile fiber member is inelastic, N=1). The value of (N) can range from about 1.0 to about 8.0, such as from about 1.0 to about 5.0.

The functional substantially planar filament(s) may take any of a variety of forms. The functional substantially planar filament may, for example, be in the form of a filament having a square, orthogonal, polygonal, or triangular cross-section as produced via a fiber spinning process, including a filament that is produced after slitting a continuous film to an appropriate width. The functional substantially planar filament may be a slit-film yarn. Alternatively, the functional substantially planar filament may take the form of a non-conductive inelastic synthetic polymer yarn having a planar filament thereon. Any combination of various forms may be used together in a composite yarn having a plurality of functional substantially planar filaments. In addition, at least one of the functional substantially planar filaments can be multifunctional, meaning that it is capable of performing more than one function.

By "functional" it is meant that the functional substantially planar filament can exhibit electrical, optical, magnetic, mechanical, chemical, semiconductive, and/or thermal energy properties.

Examples of functional materials include, but are not limited to, electrically active materials, optically active materials, and magnetically active materials. Included among functional materials are those that present: electrical function (e.g., electrical conductivity, electrical capacitance, piezoelectric activity, ferroelectric activity, electrostrictive activity, electrochromic activity); optical function (e.g., photonic crystal materials, photoluminescent materials, luminescent materials, light transmitting materials, reflective materials); magnetic function (e.g., magnetostrictive activity); thermoresponsive function (e.g., shape memory polymers or alloys); semiconductive function (e.g., transistors, diodes, gate electrodes); and sensoral function (e.g., chemical, bio, capacitive). Such functional materials can be included in functional substantially planar filaments used in embodiments of the present invention.

For example, in one embodiment, a functional material can be patterned to create a printed electronic circuit, for example, a bus created by parallel conductive pathways. In addition, functional substantially planar filaments can include multilayered structures. Such structures can function, for example, as: capacitor; a transistor; an integrated circuit; a material having thermoelectric effects; a gated electronic structure; a diode; a photoactive material; a light-emitting material; a sensor; a material that provides shape memory; an electrical transformer; or a carrier for microencapsulated agents or particles. When acting as a carrier for microencapsulated agents or particles, such agents or particles can be released under an external field or other environmental stimuli, such as, for example, temperature, pH, humidity, friction, or barometric pressure.

The composite yarns according to the invention may be "multifunctional", meaning the functional substantially planar filament can exhibit combinations of electrical, optical, magnetic, mechanical, chemical, semiconductive, and/or thermal energy properties. Alternatively, a composite yarn may be made multifunctional by incorporating multiple functional substantially planar filaments with different energy active properties into such composite yarn.

Figure 5:
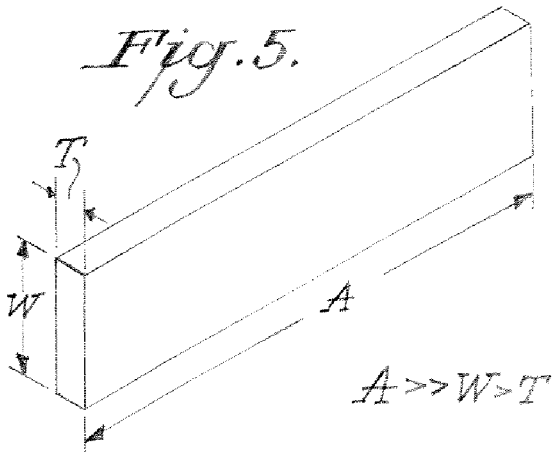
FIG. 5 is schematic representation of a substantially planar filament.

By "planar" it is meant that the functional substantially planar filament has dimensions normal to a longitudinal axis (A) of the filament which define a width dimension (W) and a thickness dimension (T) such that the longitudinal axis (A) is much greater than the width (W), which is greater than the thickness (T): A>>W>T (see FIG. 5).

In one embodiment, the functional substantially planar filament covers the textile fiber member. Such functional substantially planar filament is wrapped in turns about the textile fiber member such that for each relaxed (stress free) unit length (L) of the textile fiber member there is at least one (1) to about ten thousand (10,000) turns of the functional substantially planar filament. Alternatively, the functional substantially planar filament may be sinuously disposed about the textile fiber member such that for each relaxed unit length (L) of the textile fiber member there is at least one period of sinuous covering over the textile fiber member by the functional substantially planar filament.

The composite yarn may further comprise at least one optional stress-bearing member, which can, for example, be one or more inelastic synthetic polymer yarn(s) surrounding the textile fiber member. Each such stress-bearing member should have a total length less than the length of the functional substantially planar filament, such that a portion of the elongating stress imposed on the composite yarn is carried by the stress-bearing member. Preferably, the total length of each stress-bearing member is greater than or equal to the drafted length (N×L) of the textile fiber member, wherein "L" is the relaxed (stress free) unit fiber length and "N" is the draft.

The stress-bearing member, such as one or more of the inelastic synthetic polymer yarn(s), may be, in one embodiment, wrapped about the textile fiber member (and the functional substantially planar filament) such that for each relaxed (stress free) unit length (L) of the textile fiber member there is at least one (1) to about ten thousand (10,000) turns of the stress-bearing member. Alternatively, the stress-bearing member may be sinuously disposed about the textile fiber member such that for each relaxed unit length (L) of the elastic member there is at least one period of sinuous covering by the stress-bearing member.

The composite yarn may further comprise a second functional substantially planar filament surrounding the textile fiber member. Such second functional substantially planar filament should also have a length that is greater than the drafted length of the textile fiber member. In one embodiment, the second functional substantially planar filament can be wrapped in turns about the textile fiber member, such that for each relaxed unit length (L) of the textile fiber member there is at least one (1) to about ten thousand (10,000) turns of the second functional substantially planar filament. In another embodiment, the second functional substantially planar filament can be sinuously disposed about the textile fiber member such that for each relaxed unit length (L) of the textile fiber member there is at least one period of sinuous covering by the second functional substantially planar filament.

The composite yarn of the present invention has an available elongation range from about 0% to about 800%, which is greater than the break elongation of the functional substantially planar filament and less than the elastic limit of the elastic member, and a breaking strength greater than the breaking strength of the functional substantially planar filament.

The present invention is also directed to methods for forming an energy active composite yarn, including an energy active multifunctional composite yarn.

The method generally includes the steps of providing at least one textile fiber member and providing for at least one functional substantially planar filament to be either situated around or co-extensive with the at least one textile fiber member.

The at least one functional substantially planar filament can be situated around or co-extensive with the at least one textile fiber member by a variety of methods. In one embodiment, the at least one functional substantially planar filament can be twisted with the at least one textile fiber member. In another embodiment, the at least one functional substantially planar filament can be wrapped about the at least one textile fiber member. In yet another embodiment, the at least one textile fiber member can be forwarded through an air jet and, within the air jet, entangled with the at least one functional substantially planar filament.

When the at least one textile fiber member includes elastic material, one method for making energy active composite yarns includes the steps of drafting the textile fiber member used within the composite yarn to its drafted length, placing each of the one or more functional substantially planar filament(s) substantially parallel to and in contact with the drafted length of the textile fiber member; and thereafter allowing the textile fiber member to relax thereby to entangle the textile fiber member and the functional substantially planar filament(s). Then, the fibers are relaxed, and the functional substantially planar filament(s) are coextensive with the textile fiber member in the composite yarn. If the energy active composite yarn includes one or more optional stress-bearing members, such as inelastic synthetic polymer yarn(s), such stress-bearing members can be placed substantially parallel to and in contact with the drafted length of the textile fiber member. When the textile fiber member thereafter is allowed to relax, the inelastic synthetic polymer yarn(s) thereby entangle with the textile fiber member and the functional substantially planar filament(s).

In accordance with other alternative methods, when the at least one textile fiber member includes elastic material, each of the functional substantially planar filament(s) and each of the stress-bearing member(s) (if the same are provided) are either twisted about the drafted textile fiber member or, in accordance with another embodiment of the method, wrapped about the drafted textile fiber member, or coextensively placed with the textile fiber member. Thereafter, in each instance, the textile fiber member is allowed to relax.

Yet another alternative method for forming an energy active composite yarn, when the at least one textile fiber member includes elastic material, includes the steps of forwarding the textile fiber member through an air jet and, while within the air jet, covering the textile fiber member with each of the functional substantially planar filament(s) and each of the stress-bearing member(s) (if the same are provided). Thereafter the textile fiber member is allowed to relax, coextensively entangling the functional substantially planar filament(s) and the textile fiber member together.

It also lies within the contemplation of the present invention to provide a knit, woven or nonwoven fabric partially or substantially wholly constructed from energy active composite yarns of the present invention. Such fabrics may be used to form a wearable garment or other fabric article.

The Textile Fiber Member

As discussed above, the textile fiber member may be elastic or inelastic.

Elastic Textile Fiber Member

When elastic, the textile fiber member may be implemented using one or more filaments of an elastic yarn, such as the spandex material sold by INVISTA S.à r.l. (3 Little Falls Centre, 2801 Centreville Road, Wilmington, Del., USA 19808) under the trademark LYCRA®.

The drafted length (N×L) of the elastic textile fiber member is defined to be that length to which the elastic textile fiber member may be stretched and return to within five percent (5%) of its relaxed (stress free) unit length (L). More generally, the draft (N) applied to the elastic textile fiber member is dependent upon the chemical and physical properties of the polymer comprising the elastic textile fiber member and the covering and textile process used. In the covering process for elastic textile fiber members made from spandex yarns, a draft of typically between about 1.0 and about 8.0 is obtainable, such as from about 1.2 to about 5.0.

Synthetic bicomponent multifilament textile yarns may also be used to form an elastic textile fiber member. Such synthetic bicomponent filament component polymers are typically thermoplastic, and can, for example be melt spun. Component polymers useful for making such synthetic bicomponent multifilament textile yarns include those selected from the group consisting of polyamides and polyesters.

One class of polyamide bicomponent multifilament textile yarns that may be used is the class of self-crimping nylon bicomponent yarns, also called "self-texturing" yarns. These bicomponent yarns can comprise a component of nylon 66 polymer or copolyamide having a first relative viscosity, and a component of nylon 66 polymer or copolyamide having a second relative viscosity, wherein both components of polymer or copolyamide are in a side-by-side relationship as viewed in the cross section of the individual filament. Included in this class of bicomponent materials is the yarn sold by INVISTA S.à r.l. (3 Little Falls Centre, 2801 Centreville Road, Wilmington, Del., USA 19808) under the trademark TACTEL® T-800™.

Examples of polyester component polymers that may be used include polyethylene terephthalate (PET), polytrimethylene terephthalate (PTT), and polytetrabutylene terephthalate. In one embodiment, polyester bicomponent filaments comprise a component of PET polymer and a component of PTT polymer, with both components of the filament in a side-by-side relationship as viewed in the cross section of the individual filament. One filament yarn meeting this description is the yarn sold by INVISTA S.à r.l. (3 Little Falls Centre, 2801 Centreville Road, Wilmington, Del., USA 19808) under the trademark T-400™ *Next Generation Fiber*. Notably, the covering process for elastic members from these bicomponent yarns generally involves the use of less draft than with spandex.

Typically, the draft for polyamide or polyester bicomponent multifilament textile yarns is from about 1.0 to about 5.0.

Inelastic Textile Fiber Member

When inelastic, the textile fiber member may, for example, be made from nonconducting inelastic synthetic polymer fiber(s) or from natural textile fibers like cotton, wool, silk, and linen. These synthetic polymer fibers may be continuous filament or staple yarns selected from multifilament flat yarns, partially oriented yarns, or textured yarns. They can further include bicomponent yarns, such as those selected from nylon, polyester, or filament yarn blends.

Where the inelastic textile fiber member includes nylon, yarns comprised of synthetic polyamide component polymers such as nylon 6, nylon 66, nylon 46, nylon 7, nylon 9, nylon 10, nylon 11, nylon 610, nylon 612, nylon 12, and mixtures and copolyamides thereof can be used. Copolyamides that can be used include nylon 66 with up to 40 mole percent of a polyadipamide, wherein the aliphatic diamine component is selected from the group of diamines available from E. I. Du Pont de Nemours and Company, Inc. (Wilmington, Del., USA, 19880) under the respective trademarks DYTEK A® and DYTEK EP®.

If the inelastic textile fiber member includes polyester, examples of polyesters that can be used include polyethylene terephthalate (2GT, a.k.a. PET), polytrimethylene terephthalate (3GT, a.k.a. PTT), or polytetrabutylene terephthalate (4GT).

For the embodiments that include inelastic textile fiber members, the drafted length (N×L) of the inelastic textile fiber member is equal to the original length of the inelastic textile fiber member, that is N is 1.0. In this case, the composite yarn is inelastic and does not have the capability to stretch and recover.

The Functional Substantially Planar Filament

The functional substantially planar filament can be made from a variety of materials using a several different types of processing techniques. For example, the functional substantially planar filament can be a slit film, a spun fiber with a planar cross-section, or a multicomponent fiber.

In one embodiment, the functional substantially planar filament includes at least one strand of energy active planar filament.

Such filament(s) may be produced by a typical fiber spinning process through spinnerets that result in a filament having a planar or substantially planar cross-section, for example square or polygonal cross-section. Such filaments may have become energy active either during the fiber spinning process (for example, via additive processes or via multicomponent fiber spinning), or after the fiber spinning process (for example, via surface modification or lamination techniques). Additive processes include those in which energy active materials or additives are incorporated into a batch or slurry of a polymer material (e.g., nylon, polyester, or acrylic) used as the base material in the functional substantially planar filament. Such energy active materials or additives can include microparticles or nanoparticles of different shapes (e.g., spheres, tubes, rods, wires). Such energy active materials or additives can also include powders. Examples of energy active materials include conductive metals (such as metal powders), conductive and semi-conductive metal oxides and salts, and carbon-based conductive materials (such as carbon black).

Alternatively, these filament(s) may be produced by providing an energy-active flexible film or web and slitting this energy active film or web to an appropriate width. For example, the film or web may have become energy active via multi-layer deposition methods or via lamination techniques. Substrate materials for the web may include silicon, for example, amorphous silicon or polycrystalline silicon. Preferably, flexible substrate materials are used, including those based on polymers such as polyethylene terephthalate (PET), polyethylene naphthalate (PEN), a polyimide, or a fluoropolymer. Functionalization of the substrates may include any available technique, including vacuum deposition, lithography, etching, and layer-by-layer (for example, printing, soft lithography, or lamination). Such functionality may be imparted to the planar filament either before or after the composite yarn formation, such that it will not significantly influence the mechanical performance of textile fiber member and, therefore, the textile stress-strain behavior of the composite yarn.

Such substantially planar filaments can further be uninsulated or insulated with a suitable electrically insulating layer, which can be based on organic material (e.g., nylon, polyurethane, polyester, polyethylene, polytetrafluoroethylene and the like) or inorganic material. Such electrically insulating layer can provide barrier properties to the energy active filament, and may, for example, limit the transportation of water and oxygen through the energy active layers.

Planar filaments can, for example, have widths from about 0.1 mm to about 7 mm and thicknesses from about 0.005 mm to about 0.3 mm, such as about 0.02 mm. The width of a planar filament should generally be greater than the diameter of a filament of the textile fiber member, and typically should be greater than the average diameter of the textile fiber member. The energy active planar filament can include at least one energy active layer, such as an anode, electrolyte, cathode, electrically conductive, or semiconductor layer.

In an alternative form, the functional substantially planar filament can include a synthetic polymer yarn having one or more conductive planar filament(s) thereon. Conductive fibers which can serve as conductive planar filaments, include polypyrrole and polyaniline coated filaments. which are disclosed for example in U.S. Pat. No. 6,360,315 to E. Smela, the entire disclosure of which is incorporated herein by reference. The functional substantially planar filament can also include nonconductive yarns. Suitable synthetic polymer nonconducting yarns include those selected from among continuous filament nylon yarns (e.g., from synthetic nylon polymers commonly designated as N66, N6, N610, N612, N7, N9), continuous filament polyester yarns (e.g., from synthetic polyester polymers commonly designated as PET, 3GT, 4GT, 2GN, 3GN, 4GN), staple nylon yarns, or staple polyester yarns. Such yarns may be formed by conventional yarn spinning techniques to produce composite yarns, such as plied, spun, or textured yarns.

Whatever form chosen, the length of the functional substantially planar filament surrounding or coextensive with the textile fiber member is determined according to the elastic limit of the textile fiber member. Thus, the planar filament surrounding a relaxed unit length L of the textile fiber member has a total unit length given by A(N×L), where A is some real number greater than one (1) and the draft N is a number in the range of about 1.0 to about 8.0. Thus the functional substantially planar filament has a length that is greater than the drafted length of the textile fiber member.

The alternative form of the functional substantially planar filament may be made by surrounding a synthetic polymer yarn with multiple turns of a planar filament.

Optional Stress-Bearing Member

The optional stress-bearing member of the energy active composite yarn of the present invention may, for example, be made from nonconducting inelastic synthetic polymer fiber (s) or from natural textile fibers like cotton, wool, silk, and linen. The inelastic synthetic polymer fibers may be continuous filament or staple yarns selected from multifilament flat yarns, partially oriented yarns, or textured yarns. They can further include bicomponent yarns such as those selected from nylon, polyester, or filament yarn blends.

If utilized, the stress-bearing member surrounding or coextensive with the elastic textile fiber member is chosen to have a total unit length of B(N×L), where B is some real number greater than one (1). The choice of the numbers A and B determines the relative lengths of the functional substantially planar filament and any stress-bearing member. Where A>B, for example, it is ensured that the functional substantially planar filament is not stressed or significantly extended near its breaking elongation. Furthermore, such a choice of A and B allows the stress-bearing member to become the strength member of the composite yarn such that it can carry substantially all the elongating stress of the extension load at the elastic limit of the elastic textile fiber member. Thus, the stress-bearing member has a total length less than the length of the functional substantially planar filament, such that a portion of the elongating stress imposed on the composite yarn is carried by the stress-bearing member. The length of the stress-bearing member should be greater than, or equal to, the drafted length (N×L) of the elastic textile fiber member.

The stress-bearing member can, for example, comprise nylon. Nylon yarns suitable for such application include, for example, those comprised of synthetic polyamide component polymers such as nylon 6, nylon 66, nylon 46, nylon 7, nylon 9, nylon 10, nylon 11, nylon 610, nylon 612, nylon 12, and mixtures and copolyamides thereof. Copolyamides that may be used include nylon 66 with up to 40 mole percent of a polyadipamide, wherein the aliphatic diamine component is selected from the group of diamines available from E. I. Du Pont de Nemours and Company, Inc. (Wilmington, Del., USA, 19880) under the respective trademarks DYTEK A® and DYTEK EP®.

When the stress-bearing member includes nylon, the composite yarn can be dyeable using conventional dyes and processes for coloration of textile nylon yarns and traditional nylon covered spandex yarns.

If the stress-bearing member includes polyester, examples of polyesters that can be used include polyethylene terephthalate (2GT, a.k.a. PET), polytrimethylene terephthalate (3GT, a.k.a. PTT), or polytetrabutylene terephthalate (4GT).

When the stress-bearing member includes polyester multifilament yarns, dyeing and handling can be accomplished using traditional textile processes.

The functional substantially planar filament and the optional stress-bearing member in one embodiment can surround the elastic member in a substantially helical fashion along the axis thereof.

The relative amounts of the functional substantially planar filament and the stress-bearing member (if used) can be selected according to ability of the elastic textile fiber member to extend and return substantially to its unstretched length (that is, undeformed by the extension) and on the properties of the functional substantially planar filament. As used herein "undeformed" means that the elastic textile fiber member returns to within about plus or minus (+/−) five percent (5%) of its relaxed (stress free) unit length (L).

Any of the traditional textile process for single covering, double covering, air jet covering, entangling, twisting, or wrapping of the elastic or inelastic textile fiber member with at least one functional substantially planar filament and the optional stress-bearing member can be suitable for making an energy active composite yarn according to the invention. Typically, the order in which the textile fiber member is combined with, surrounded by or covered by the functional substantially planar filament and the optional stress-bearing member can be expected to be immaterial for obtaining an energy active composite yarn.

One desirable characteristic of energy active composite yarns falling within the scope of the invention is their stress-strain behavior. For example, under the stress of an elongating applied force, the functional substantially planar filament of the composite yarn, when disposed about the textile fiber member in multiple wraps (typically from one turn or single wrap to about 10,000 turns), is free to extend without strain.

Similarly, the optional stress-bearing member, when also disposed about the textile fiber member in multiple wraps (typically from one turn or a single wrap to about 10,000 turns), is free to extend. If the composite yarn is stretched near to the break extension of the textile fiber member, the stress-bearing member is available to take a portion of the load and effectively preserve the textile fiber member and the functional substantially planar filament from breaking. The term "portion of the load" is used herein to mean any amount from about 1% to about 99% of the load, such as from about 10% to about 80% of the load, including from about 25% to about 50% of the load.

Figure 2:
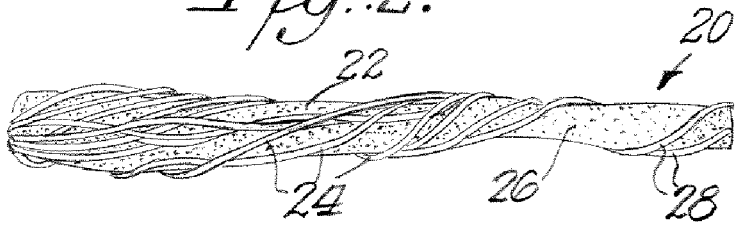
FIG. 2 is a schematic representation of an elastic energy active composite yarn of the present invention in a stretched state, wherein the yarn includes an elastic monofilament Lycra® fiber core wrapped with an inelastic textile multifilament fiber in the "S" direction and with a slit energy active film in the "Z" direction.
Figure 3:
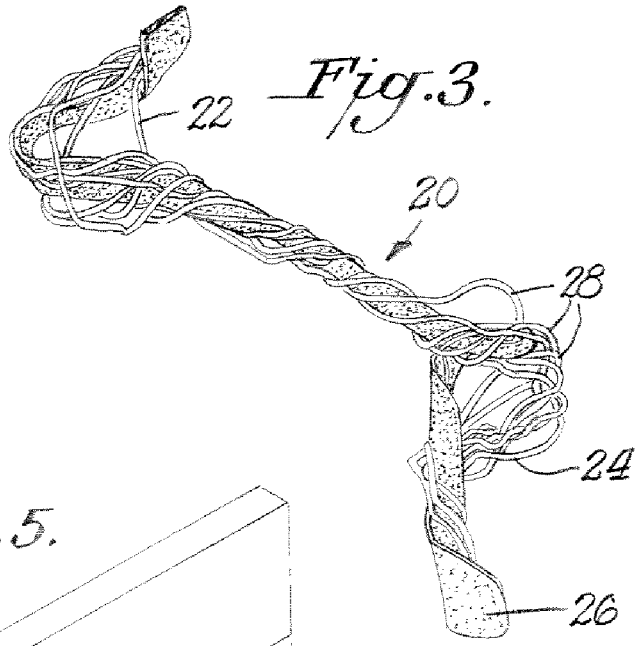
FIG. 3 is a schematic representation of the elastic energy active composite yarn of FIG. 2 of the present invention in a relaxed state.

FIGS. 1-3 are schematic representations of potential constructions of yarns that can be made according to the invention. Such constructions are exemplary and numerous variations are possible within the scope of this invention. These representations also relate to textile yarns sold under the brand name Lurex®. However, the yarns of the invention contain functional planar elements (i.e., elements that are, for example, energy active or multifunctional) whereas the Lurex® yarns contain planar elements that are simple metallized non-conductive slit films (i.e., planar elements that are nonfunctional).

FIG. 1 is a schematic representation of an inelastic energy active composite yarn 10 of the present invention, including an inelastic textile fiber core 12 having two strands 14, 16 of nylon multi-filament yarns twisted together and a slit energy active film 18 wrapped about the textile core 12. Such yarn has alternate non-energy active and energy active portions. Referring to FIG. 1 as illustrative, the wraps of the energy-active film 18 are characterized by a sinuous period (P).

FIG. 2 is a schematic representation of an alternative elastic energy active composite yarn 20 of the present invention in a stretched state. The yarn 20 includes an elastic monofilament Lycra® fiber core 22 wrapped around by an inelastic textile multifilament fiber 24 in the "S" direction and by a slit energy active film 26 in the "Z" direction. The slit energy active film 26 includes a composite yarn having the slit film 26 and an inelastic textile multifilament fiber 28 twisted together. Such yarn has alternate non-energy active and energy active portions.

FIG. 3 is a schematic representation of the elastic energy active composite yarn of FIG. 2 of the present invention in a relaxed state.

EXAMPLE

A specific embodiment of the present invention will now be described by way of the following Example, which is for the purpose of illustration only.

A composite yarn was made by wrapping a 78 decitex (dtex) elastic core made of Lycra® spandex yarn with a flat metal ribbon having a thickness (T) of 40 μm and a width (W) of 210 μm obtained from Rea Magnet Wire Company, Inc., USA. The Lycra® spandex elastic core yarn was first drafted to a value of 3.6 times (i.e., N=3.6) and then wrapped at 250 turns/meter (turns of flat ribbon per meter of drafted Lycra® spandex yarn) with a single length of the flat metal ribbon twisted in the "S" direction. An electrically conductive composite yarn having a planar element was produced. The flat metal ribbon covering was done using a standard process on an I.C.B.T. machine, model G307.

Figure 4:
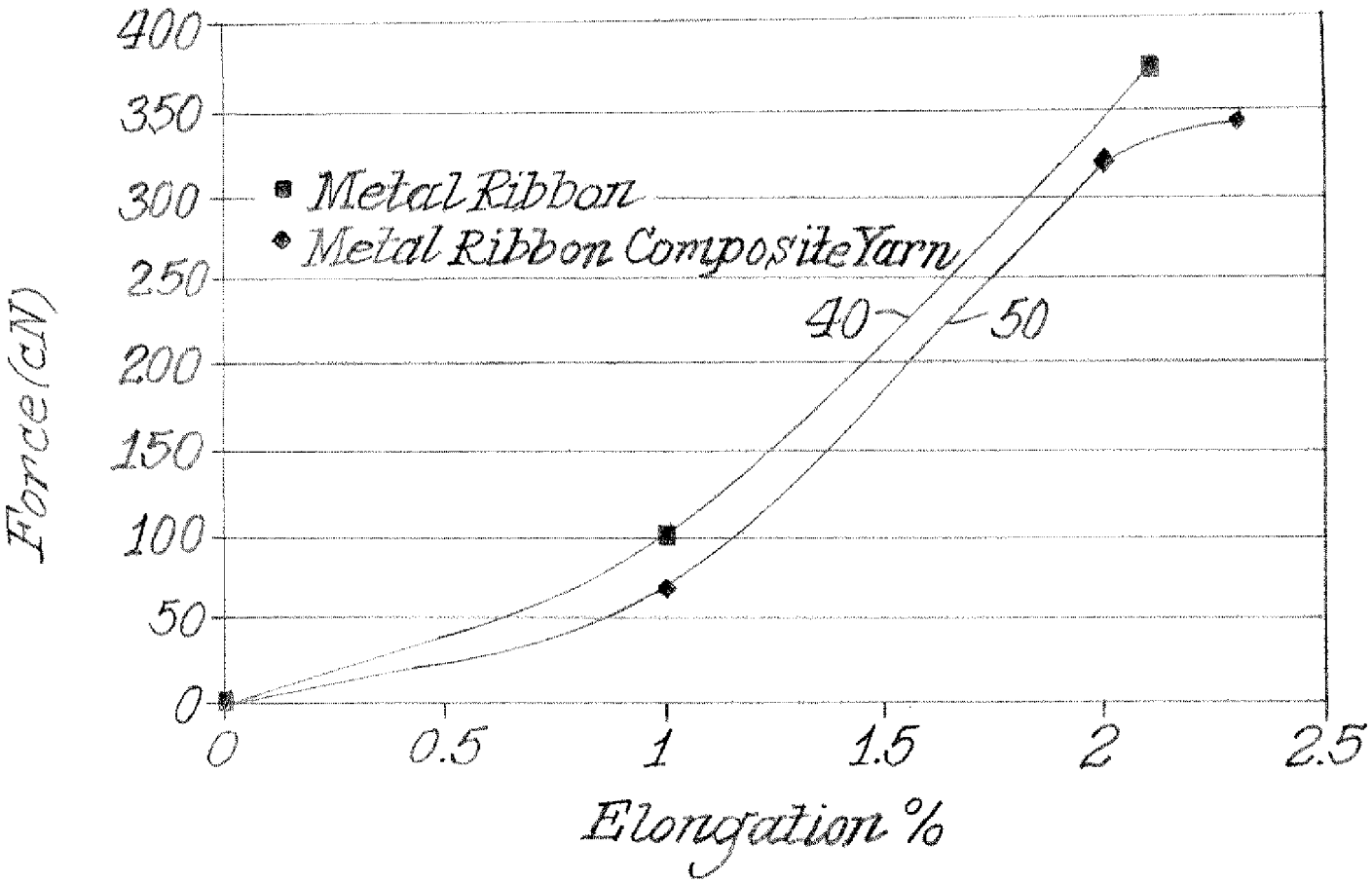
FIG. 4 is a graphical representation of the stress-strain curve for an embodiment of an elastic energy active composite yarn of the invention.

The stress-strain properties of the metal ribbon (40) alone and of the composite yarn (50) of this Example are shown in FIG. 4. The composite yarn (50) had stress-strain properties that, compared to the metal ribbon (40) alone, were closer to what would be expected for a textile yarn, namely a softer modulus and higher elongation to break.

Nothing in this specification should be considered as limiting the scope of the present invention. All examples presented are representative and non-limiting. The above described embodiments of the invention may be modified or varied, and elements added or omitted, without departing from the invention, as appreciated by persons skilled in the art in light of the above teachings. It is therefore to be understood that the invention is to be measured by the scope of the claims, and may be practiced in alternative manners to those which have been specifically described in the specification.

What is claimed as new and desired to be protected by Letters Patent of the United States is:

1. An energy active composite yarn comprising:

at least one textile fiber member having a relaxed unit length (L) and a drafted length of (N×L), wherein N is in the range of about 1.0 to about 8.0; and at least one functional substantially planar filament surrounding the textile fiber member, wherein the functional substantially planar filament comprises at least one material selected from the group consisting of an electrically active material, an optically active material, and a magnetically active material, and wherein the functional substantially planar filament has a length that is greater than the drafted length of the textile fiber member, such that substantially all of an elongating stress imposed on the composite yarn is carried by the textile fiber member.

2. The energy active composite yarn of claim 1, wherein the textile fiber member comprises an elastic material.

3. The energy active composite yarn of claim 2, wherein N is in the range of about 1.0 to about 5.0.

4. The energy active composite yarn of claim 2, wherein the elastic material comprises spandex.

5. The energy active composite yarn of claim 1, wherein the textile fiber member comprises an inelastic material.

6. The energy active composite yarn of claim 5, wherein the inelastic material comprises nylon.

7. The energy active composite yarn of claim 1, wherein the functional substantially planar filament comprises at least one material selected from the group consisting of a conductive material, a semiconductive material, a dielectric material, an insulating material, a piezoelectric material, a ferroelectric material, a shape memory material, a light emitting material, a transducer, an optical material and a magnetic material.

8. The energy active composite yarn of claim 1, wherein the composite yarn is multifunctional.

9. The energy active composite yarn of claim 1, wherein the at least one material is patterned to create printed electronic circuits.

10. The energy active composite yarn of claim 9, wherein the at least one material comprises a bus created by parallel conductive pathways.

11. The energy active composite yarn of claim 1, wherein the functional substantially planar filament comprises a multilayered structure.

12. The energy active composite yarn of claim 11, wherein the multilayered structure can function as: a capacitor; a transistor; an integrated circuit; a material having thermoelectric effects; a gated electronic structure; a diode; a photoactive material; a light-emitting material; a sensor; a material that provides shape memory; an electrical transformer; or a carrier for microencapsulated agents or particles.

13. The energy active composite yarn of claim 1, wherein the functional substantially planar filament has an insulating coating thereon.

14. The energy active composite yarn of claim 1, wherein the functional substantially planar filament is a slit film.

15. The energy active composite yarn of claim 1, wherein the functional substantially planar filament is a spun fiber with a planar cross-section.

16. The energy active composite yarn of claim 15, wherein the functional substantially planar filament is a multicomponent fiber.

17. The energy active composite yarn of claim 1, wherein the at least one functional substantially planar filament is wrapped in turns about the textile fiber member, such that for each relaxed unit length (L) of the textile fiber member there is at least one (1) to about ten thousand (10,000) turns of the functional substantially planar filament.

18. The energy active composite yarn of claim 1, wherein the at least one functional substantially planar filament is sinuously disposed about the textile fiber member such that for each relaxed unit length (L) of the textile fiber member there is at least one period of sinuous covering by the functional substantially planar filament.

19. The energy active composite yarn of claim 1, further comprising a second functional substantially planar filament surrounding the textile fiber member, the second functional substantially planar filament having a length that is greater than the drafted length of the textile fiber member.

20. The energy active composite yarn of claim 19, wherein the second functional substantially planar filament is wrapped in turns about the textile fiber member, such that for each relaxed unit length (L) of the textile fiber member there is at least one (1) to about ten thousand (10,000) turns of the second functional substantially planar filament.

21. The energy active composite yarn of claim 19, wherein the second functional substantially planar filament is sinuously disposed about the textile fiber member such that for each relaxed unit length (L) of the textile fiber member there is at least one period of sinuous covering by the second functional substantially planar filament.

22. The energy active composite yarn of claim 1, further comprising: at least one stress-bearing member surrounding the textile fiber member, and wherein the at least one stress-bearing member has a total length less than the length of the functional substantially planar filament and greater than, or equal to, the drafted length (N×L) of the textile fiber member, such that a portion of the elongating stress imposed on the composite yarn is carried by the at least one stress-bearing member.

23. The energy active composite yarn of claim 22, wherein the stress-bearing member is made from an inelastic synthetic polymer yarn.

24. The energy active composite yarn of claim 22, wherein the at least one stress-bearing member is wrapped in turns about the textile fiber member such that for each relaxed unit length (L) of the textile fiber member there is at least one (1) to about ten thousand (10,000) turns of stress-bearing member.

25. The energy active composite yarn of claim 22, wherein the at least one stress-bearing member is sinuously disposed about the textile fiber member such that for each relaxed unit length (L) of the textile fiber member there is at least one period of sinuous covering by the stress-bearing member.

26. A fabric comprising the energy active composite yarn according to claim 1.

27. The fabric of claim 26, wherein the textile fiber member comprises an elastic material.

28. The fabric of claim 27, wherein the elastic material comprises spandex.

29. The fabric of claim 26, wherein the textile fiber member comprises an inelastic material.

30. The fabric of claim 29, wherein the inelastic material comprises nylon.

31. The fabric of claim 26, wherein the functional substantially planar filament comprises at least one material selected from the group consisting of an electrically conductive material, an optically active material and a magnetically active material.

32. The fabric of claim 26, wherein the functional substantially planar filament comprises at least one material selected from the group consisting of a conductive material, a semiconductive material, a dielectric material, an insulating material, a piezoelectric material, a ferroelectric material, a shape memory material, a light-emitting material, a transducer, an optical material and a magnetic material.

33. The fabric of claim 26, wherein the energy active composite yarn further comprises:

at least one stress-bearing member surrounding the textile fiber member, and wherein the at least one stress-bearing member has a total length less than the length of the functional substantially planar filament and greater than, or equal tot the drafted length (N×L) of the textile fiber member, such that a portion of the elongating stress imposed on the composite yarn is carried by the at least one stress-bearing member.

34. A garment comprising the fabric of claim 26.

* * * * *